United States Patent [19]

Jones et al.

[11] 4,079,190

[45] Mar. 14, 1978

[54] SUBMARINE COAXIAL CABLE

[75] Inventors: Stephen Robert Jones, Romsey; John Robert Lawrence, Eastleigh, both of England

[73] Assignee: International Standard Electric Corporation, New York, N.Y.

[21] Appl. No.: 765,072

[22] Filed: Feb. 3, 1977

[51] Int. Cl.[2] ..... H01B 7/18; H01B 7/14

[52] U.S. Cl. ..... 174/102 R; 174/36; 174/107

[58] Field of Search ..... 174/36, 102 R, 102 D, 174/103, 105 R, 106 R, 106 D, 107; 156/54

[56] References Cited

U.S. PATENT DOCUMENTS

| | | | |
|---|---|---|---|
| 3,272,912 | 9/1966 | Jachimowicz | 174/36 X |
| 3,274,329 | 9/1966 | Timmons | 174/107 X |
| 3,651,244 | 3/1972 | Silver | 174/107 X |
| 3,703,605 | 11/1972 | Dembiak et al. | 174/107 |
| 3,849,591 | 11/1974 | Ichiba et al. | 174/107 |
| 3,943,271 | 3/1976 | Bahder et al. | 174/102 D |
| 3,968,321 | 7/1976 | Olszewski et al. | 174/107 X |

*Primary Examiner*—Arthur T. Grimley
*Attorney, Agent, or Firm*—Thomas L. Peterson

[57] ABSTRACT

The electrical screening characteristics of a submarine coaxial cable are significantly improved by increasing the overlap between the longitudinal edges of the tape return conductor to at least 10% of the return conductor circumferential length.

5 Claims, 2 Drawing Figures

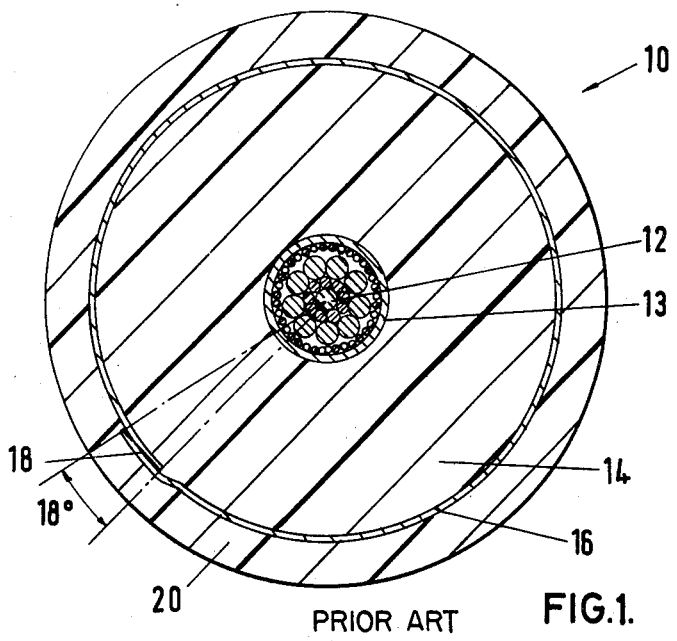
PRIOR ART FIG.1.
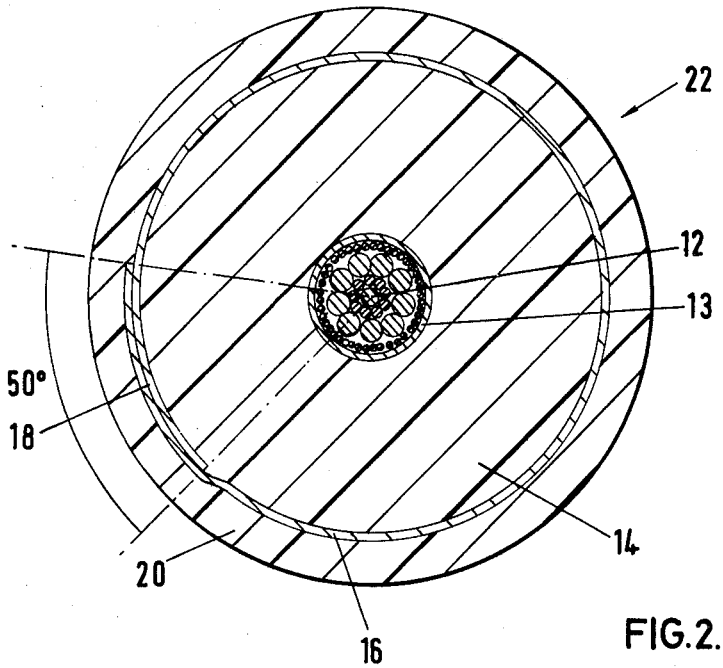
FIG.2.

SUBMARINE COAXIAL CABLE

BACKGROUND OF THE INVENTION

This invention relates to submarine coaxial cables.

There is presently manufactured submarine coaxial cables comprising a central strength member sheathed in copper to act as an electrical conductor, polyethylene insulation surrounding this inner conductor, an outer return conductor surrounding the insulation, and finally, an outer polyethylene sheath extruded around the return conductor.

The return conductor is formed from a metal tape (e.g. copper) folded around the insulation with a longitudinal seam where the longitudinal edges of the tape overlap. The overlap of the edges of the tape is typically about one quarter of an inch for 1.47 inch diameter submarine cable, or about 5% of the return conductor circumferential length. This return conductor does not act as an efficient screen owing to the "leakage" which will occur along the seam because the overlapping edges are not galvanically connected otherwise than as may occur as a result of simple abutment together.

For the major part of the length of a submarine cable transmission system the return conductor is not required to screen the inner conductor from interference et cetera because no interference is likely to occur at the water depth encountered. However, toward the terminal ends of the system on land and where it approaches the land in shallow water, screening is desirable.

The conventional screening technique comprises helically winding six very thin mild steel tapes with a long lay (approximately 12 inches) and with a helical gap. This winding is bound by a thin copper tape about 2 inches wide and also helically wound. Then a proofed cotton tape which acts as a bedding is wound on, and a single steel tape is applied longitudinally with a gap. Then soft steel tapes are helically wound first right then left then right then left. The whole is sheathed in polythene and the normal wire armouring, if necessary, is applied comprising steel wires and jute bedding. The aforementioned screening technique is obviously expensive, and substantially increases the cable size and weight.

The purpose of the present invention is to provide a cable screening technique which is less expensive, simpler and smaller than the present technique.

SUMMARY OF THE INVENTION

We have discovered that a small increase in the amount of overlap of the longitudinal edges of the return conductor of a coaxial submarine cable results in a very marked improvement in the screening capability of the return conductor. Therefore, according to one aspect of the present invention, there is provided a coaxial cable having an outer return conductor formed from a longitudinally-applied strip of conductive material with overlapping longitudinal edges, the amount of overlap being in the range 10–20% of the return conductor circumferential length in radial cross-section.

We believe that the amount of overlap at which a satisfactory screening occurs, expressed as a percentage of the circumference of the return conductor, is around 10%. Preferably, the overlap is between 14% and 18% of the return conductor circumference. We have found no real advantage in having an overlap which is greater than 20% of the return conductor circumference because no further screening improvement is noted beyond this value and there is, of course, an increasing amount of the conductor material being used which becomes unnecessarily expensive.

According to a further aspect of the present invention, there is provided a submarine cable system comprising a coaxial cable having an outer return conductor formed from a longitudinally applied strip of conductive material with overlapping longitudinal edges. The amount of overlap of the edges is less than 10% of the return conductor circumferential length in radial cross-section for that lengthwise portion of the cable intended for deeper water. The amount of overlap is in the range 10%–20% of the return conductor perimeter for another lengthwise portion of the cable intended for the shallow water or land based part of the system.

BRIEF DESCRIPTION OF THE DRAWINGS

FIG. 1 is a cross-section of a conventional submarine coaxial cable, without the screening; and FIG. 2 is a cross-section of a submarine coaxial cable in accordance with the present invention.

DESCRIPTION OF THE PREFERRED EMBODIMENTS

In order that the invention can be clearly understood, reference is first made to FIG. 1 of the drawing which illustrates a conventional submarine coaxial cable, generally designated 10. The central strength member 12 of the cable comprises a plurality of high tensile steel strength members surrounded by a tubular copper inner conductor 13. Polyethylene insulation 14 is extruded over the inner conductor, is shaved to precise dimensions and the copper outer conductor 16 comprises a copper tape 0.020–0.025 inch thick folded around the insulation 14 so that the longitudinal edges overlap at 18. An outer polyethylene sheath 20 is extruded around the return conductor 16. As stated previously, the overlap 18 represents approximately 5% of the return conductor circumference. Hence, as indicated in FIG. 1, the overlap subtends an angle at the cable center of approximately 18°.

The return conductor 16 does not act as an efficient screen owing to the "leakage" which will occur along the seam 18 because the overlapping edges are not galvanically connected otherwise than as may occur as a result of simple abutment together. Therefore, a separate metallic screen as described hereinbefore (not shown) is required for the outer conductor in the portion of the cable intended for shallow water and land use.

Reference is not made to FIG. 2 of the drawing which illustrates a cable constructed in accordance with the present invention, generally designated 22. The cable 22 as illustrated is identical to cable 10, except that the overlap 18 subtends an angle at the cable center of approximately 50° and no separate screening is required. The increased overlap provides the screening. As shown, the overlap 18 represents approximately 14% of the return conductor circumference. The return conductor circumference is approximately 4.6 inches. FIGS. 1 and 2 are drawn approximately to scale and so the dimensions of the other components can be deduced approximately. Although not shown, some wire armouring would be applied around the outer sheath 20 of the cable in order to protect the cable against trawler nets, anchors and the like which could otherwise damage the cable for the shallow water and land-based part of the system. The deep water part of the system can still use cable according to FIG. 1 where screening is not a problem.

The cable is intended to operate at frequencies between 1 MHz and 45 MHz or thereabouts and the improved screening is effective for cables used at these frequencies. A significant improvement in durability as a result of flexing is achieved with the new screening technique and larger diameter cables can be produced as a result.

The embodiment described enables the conventional screening technique to be dispensed with and in fact a sample of cable we have manufactured which was similar to FIG. 2 but in which the overlap was 18%, was found to have a transfer impedance 13 db better (0 db equals 1 ohm/meter) than cable constructed according to FIG. 1 and screened in a conventional manner.

What is claimed is:

1. A submarine coaxial cable having an outer return conductor formed from a longitudinally-applied strip of conductive material with overlapping longitudinal edges wherein the improvement comprises:

the amount of overlap of said edges being in the range 10–20% of the return conductor circumferential length in radial cross-section.

2. A cable as set forth in claim 1 wherein:

said overlap lies in the range 14–18% of said circumferential length.

3. A cable as set forth in claim 1 wherein:

said return conductor comprises a copper tape.

4. A cable as set forth in claim 1 wherein:

the thickness of said return conductor is between 0.020 and 0.025 inch.

5. A submarine cable system comprising:

a coaxial cable having an outer return conductor formed from a longitudinally applied strip of conductive material with overlapping longitudinal edges;

said cable having a first lengthwise portion intended for deeper water and a second lengthwise portion intended for shallow water or land;

the amount of overlap of said edges being less than 10% of the return conductor circumferential length in radial cross-section for said first portion of the cable; and the amount of overlap of said edges being in the range 10–20% of the return conductor perimeter for said second portion of the cable.

* * * * *